US008789389B2

(12) United States Patent
Ogasawara et al.

(10) Patent No.: US 8,789,389 B2
(45) Date of Patent: Jul. 29, 2014

(54) INTERMEDIATE HEAT EXCHANGER

(75) Inventors: Noboru Ogasawara, Oyama (JP); Tatsuya Hanafusa, Oyama (JP); Makoto Numasawa, Oyama (JP)

(73) Assignee: Showa Denko K.K., Tokyo (JP)

( * ) Notice: Subject to any disclaimer, the term of this patent is extended or adjusted under 35 U.S.C. 154(b) by 280 days.

(21) Appl. No.: 13/390,749

(22) PCT Filed: Oct. 12, 2010

(86) PCT No.: PCT/JP2010/067836
§ 371 (c)(1),
(2), (4) Date: Apr. 25, 2012

(87) PCT Pub. No.: WO2011/046099
PCT Pub. Date: Apr. 21, 2011

(65) Prior Publication Data

US 2012/0234517 A1 Sep. 20, 2012

(30) Foreign Application Priority Data

Oct. 13, 2009 (JP) ..... 2009-235902
Jul. 30, 2010 (JP) ..... 2010-172087

(51) Int. Cl.
*F25B 41/00* (2006.01)

(52) U.S. Cl.
USPC ..... 62/513

(58) Field of Classification Search
USPC ..... 62/498, 513, 515; 165/104.21, 141, 154
See application file for complete search history.

(56) References Cited

U.S. PATENT DOCUMENTS 6,314,742 B1 * 11/2001 Yoneda ..... 62/51.1
7,797,955 B2 * 9/2010 Ohta ..... 62/196.4
2006/0260354 A1 * 11/2006 Nakatani et al. ..... 62/513
2007/0227165 A1 * 10/2007 Ohta ..... 62/196.1

FOREIGN PATENT DOCUMENTS

JP 08-166172 A 6/1996
JP 2000-205706 A 7/2000
JP 2000-346469 A 12/2000
JP 2005-022601 A 1/2005
JP 2005-114283 A 4/2005
JP 2009-092276 A 4/2009

OTHER PUBLICATIONS

International Search Report dated Nov. 22, 2010, issued for PCT/JP2010/067836.

* cited by examiner

*Primary Examiner* — Melvin Jones
(74) *Attorney, Agent, or Firm* — Edwards Wildman Palmer LLP

(57) ABSTRACT

An intermediate heat exchanger 10 includes a double tube 11 and a liquid reservoir 14. The double tube 11 has an outer tube 15 and an inner tube 16 disposed inside the outer tube 15 with a clearance formed therebetween. The clearance between the outer tube 15 and the inner tube serves as a high-temperature-side refrigerant passage 12, through which refrigerant of high pressure flowing out of a condenser flows, and the interior of the inner tube 16 serves as a low-temperature-side refrigerant passage 13, through which refrigerant of low pressure flowing out of an evaporator flows. The liquid reservoir 14, which communicates with the high-temperature-side refrigerant passage 12 of the double tube 11, stores the refrigerant of high pressure flowing out of the condenser before the pressure of the refrigerant is reduced by a pressure reducer, and separate liquid-phase refrigerant and gas-phase refrigerant. The outer tube 15 of the double tube 11 has a refrigerant inlet 17 and a refrigerant outlet 18 communicating with the high-temperature-side refrigerant passage 12. At an intermediate position between the refrigerant inlet 17 and the refrigerant outlet 18, refrigerant flows from the high-temperature-side refrigerant passage 12 of the double tube 11 into the liquid reservoir 14, and returns from the liquid reservoir 14 to the high-temperature-side refrigerant passage 12.

17 Claims, 9 Drawing Sheets

INTERMEDIATE HEAT EXCHANGER

TECHNICAL FIELD

The present invention relates to an intermediate heat exchanger used in an air conditioner mounted on, for example, a vehicle.

Herein and in the appended claims, the term "liquid-phase refrigerant" refers not only to refrigerant composed solely of liquid-phase refrigerant, but also to refrigerant composed of a predominant amount of liquid-phase refrigerant and a minute amount of gas-phase refrigerant mixed therein; and the term "gas-phase refrigerant" refers not only to refrigerant composed solely of gas-phase refrigerant, but also to refrigerant composed of a predominant amount of gas-phase refrigerant and a minute amount of liquid-phase refrigerant mixed therein.

BACKGROUND ART

In the following description, like portions and like members are denoted by the same reference numerals throughout the drawings, and their repeated descriptions will not be provided.

An air conditioner mounted on a vehicle (hereinafter referred to as a "vehicular air conditioner") is known (see Patent Document 1). As shown in FIG. 9, such a vehicular air conditioner includes a compressor (1); a condenser (2) for cooling refrigerant compressed by the compressor (1); an expansion valve (pressure reducer) (3) for reducing the pressure of the refrigerant cooled by the condenser (2); an evaporator (4) for evaporating the pressure-reduced refrigerant; a double-tube heat exchanger (5) which has a high-temperature-side refrigerant passage (6) and a low-temperature-side refrigerant passage (7) and in which heat exchange occurs between refrigerant of high temperature and high pressure (refrigerant flowing through the high-temperature-side refrigerant passage (6) after flowing out of the condenser (2)) and refrigerant of low temperature and low pressure (refrigerant flowing through the low-temperature-side refrigerant passage (7) after flowing out of the evaporator (4)); and a liquid reservoir (8) for storing the refrigerant of high temperature and high pressure (the refrigerant flowing out of the condenser (2)) in a stage before the refrigerant is reduced in pressure by the expansion valve (3) and for separating liquid-phase and gas-phase portions of the refrigerant from each other. The liquid reservoir (8) is provided between the condenser (2) and the intermediate heat exchanger (5). The refrigerant enters the liquid reservoir (8) before flowing into the high-temperature-side refrigerant passage (6) of the double-tube heat exchanger (5). After flowing out of the liquid reservoir (8), the refrigerant flows into the high-temperature-side refrigerant passage (6) of the double-tube heat exchanger (5).

In the vehicular air conditioner described in Patent Document 1, the refrigerant of high temperature and high pressure compressed by the compressor (1) (see a state A in FIG. 10) is cooled in the condenser (2) (see a state B in FIG. 10). The cooled refrigerant flows into the liquid reservoir (8), where liquid phase and gas phase portions of the refrigerant are separated from each other. The refrigerant flowing out of the liquid reservoir (8) flows into the high-temperature-side refrigerant passage (6) of the double-tube heat exchanger (5). While flowing through the high-temperature-side refrigerant passage (6), the refrigerant is super-cooled by the refrigerant of relatively low temperature flowing through the low-temperature-side refrigerant passage (7) after flowing out of the evaporator (4) (see a state C in FIG. 10). The refrigerant of high pressure supper-cooled in the double-tube heat exchanger (5) is caused to adiabatically expand in the expansion valve (3), whereby the pressure of the refrigerant is reduced (see a state D in FIG. 10). The refrigerant of reduced pressure enters the evaporator (4), and cools air flowing through air-passage clearances, while flowing through the evaporator (4), whereby the refrigerant becomes gas-phase refrigerant (see a state E in FIG. 10). The refrigerant of relatively low temperature flowing out of the evaporator (4) passes through the low-temperature-side refrigerant passage (7) of the double-tube heat exchanger (5). The low-temperature-side refrigerant passing through the low-temperature-side refrigerant passage (7) of the double-tube heat exchanger (5) is heated to higher temperature (see a state F in FIG. 10) by the high-temperature-side refrigerant passing through the high-temperature-side refrigerant passage (6). The heated refrigerant is then fed to the compressor (1) and is compressed.

Incidentally, in the vehicular air conditioner described in Patent Document 1, the refrigerant flowing into the liquid reservoir (8) is in the state B of FIG. 10. In order to efficiently separate liquid-phase refrigerant and gas-phase refrigerant within the liquid reservoir (8), the liquid-phase refrigerant within the liquid reservoir (8) must be stably maintained in the liquid phase, without changing to gas-phase refrigerant. In order to stably maintain the liquid-phase refrigerant in the liquid phase, without changing it to gas-phase refrigerant, within the liquid reservoir (8), in actuality, the refrigerant flowing into the liquid reservoir (8) must be super-cooled by about 3 to 5° C. Therefore, in the vehicular air conditioner described in Patent Document 1, the refrigerant must be super-cooled by about 3 to 5° C. in the condenser (2). However, in the case where the refrigerant is super-cooled in the condenser (2), the following problem arises. In an assumed case where the area of the effective core section of the condenser (2) is unchanged, the area of a portion contributing to condensation of the refrigerant must be reduced, whereby the refrigerant condensation efficiency of the condenser (2) drops. In addition, when the refrigerant condensation efficiency of the condenser (2) drops, the amount of refrigerant circulating through the vehicular air conditioner must be reduced, which results in deterioration of cooling capacity. Also, in the case where the refrigerant is super-cooled in the condenser (2), super-cooling efficiency greatly varies depending on the velocity of wind which the condenser (2) receives, wind velocity distribution, and outside air temperature.

PRIOR ART DOCUMENT

Patent Document

Patent Document 1: Japanese Patent Application Laid-Open (kokai) No. 2005-22601

SUMMARY OF THE INVENTION

Problems to be Solved by the Invention

An object of the present invention is to solve the above-described problems and to provide an air conditioner which can prevent drop in the refrigerant condensation efficiency of a condenser.

To achieve the above object, the present invention comprises the following modes.

1) An intermediate heat exchanger used in an air conditioner including a compressor, a condenser for cooling refrigerant compressed by the compressor, a pressure reducer for reducing pressure of the refrigerant cooled by the condenser, and an evaporator for evaporating the refrigerant of reduced pressure, the intermediate heat exchanger exchanging heat between refrigerant of high pressure flowing out of the condenser and refrigerant of low pressure flowing out of the evaporator, wherein the intermediate heat exchanger is composed of a double tube which includes an outer tube and an inner tube disposed inside the outer tube with a clearance formed therebetween, the clearance formed between the outer tube and the inner tube serving as a high-temperature-side refrigerant passage through which the refrigerant of high pressure flowing out of the condenser flows, and the interior of the inner tube serving as a low-temperature-side refrigerant passage through which the refrigerant of low pressure flowing out of the evaporator flows; and a liquid reservoir communicating with the high-temperature-side refrigerant passage of the double tube, the liquid reservoir storing the refrigerant of high pressure, flowing out of the condenser, in a stage before the pressure of the refrigerant is reduced by the pressure reducer, and separating liquid-phase refrigerant and gas-phase refrigerant from each other; and the outer tube of the double tube has a refrigerant inlet and a refrigerant outlet which communicate with the high-temperature-side refrigerant passage, wherein, at an intermediate position between the refrigerant inlet and the refrigerant outlet, the refrigerant of high pressure enters the liquid reservoir from the high-temperature-side refrigerant passage of the double tube, and returns from the liquid reservoir to the high-temperature-side refrigerant passage.

2) An intermediate heat exchanger according to par. 1), 1, wherein the double tube has a U-shaped portion which opens upward and which is composed of two opposed portions and a connection portion which connects lower end portions of the opposed portions together, wherein, at the connection portion of the U-shaped portion, the refrigerant flows from the high-temperature-side refrigerant passage of the double tube into the liquid reservoir, and returns from the liquid reservoir to the high-temperature-side refrigerant passage.

3) An intermediate heat exchanger according to par. 1), wherein the double tube has an L-shaped portion which is composed of a horizontal portion and a vertical portion extending from one end portion of the horizontal portion, wherein, at the horizontal portion of the L-shaped portion, the refrigerant flows from the high-temperature-side refrigerant passage of the double tube into the liquid reservoir, and returns from the liquid reservoir to the high-temperature-side refrigerant passage.

4) An intermediate heat exchanger according to par. 1), wherein the high-temperature-side refrigerant passage of the double tube is divided into a refrigerant inlet side portion and a refrigerant outlet side portion; the liquid reservoir has a refrigerant inflow port and a refrigerant outflow port; and communication is established between the refrigerant inlet side portion of the high-temperature-side refrigerant passage of the double tube and the refrigerant inflow port of the liquid reservoir, and communication is established between the refrigerant outlet side portion of the high-temperature-side refrigerant passage of the double tube and the refrigerant outflow port of the liquid reservoir.

5) An intermediate heat exchanger according to par. 4), wherein a connection pipe which is joined at one end thereof to the outer tube of the double tube and is joined at the other end thereof to the liquid reservoir establishes communication between the refrigerant inlet side portion of the high-temperature-side refrigerant passage of the double tube and the refrigerant inflow port of the liquid reservoir, and another connection pipe which is joined at one end thereof to the outer tube of the double tube and is joined at the other end thereof to the liquid reservoir establishes communication between the refrigerant outlet side portion of the high-temperature-side refrigerant passage of the double tube and the refrigerant outflow port of the liquid reservoir.

6) An intermediate heat exchanger according to par. 4), wherein the outer tube of the double tube is composed of two tubular constituting portions; and the refrigerant inlet side portion of the high-temperature-side refrigerant passage is provided in one tubular constituting portion, and the refrigerant outlet side portion of the high-temperature-side refrigerant passage is provided in the other tubular constituting portion.

7) An intermediate heat exchanger according to par. 1), wherein the liquid reservoir has a refrigerant passage port located below an interface between liquid-phase refrigerant and gas-phase refrigerant within the liquid reservoir, and communication is established between the high-temperature-side refrigerant passage of the double tube and the refrigerant passage port of the liquid reservoir.

8) An intermediate heat exchanger according to par. 7), wherein an opening is formed in the outer tube of the double tube for enabling the high-temperature-side refrigerant passage to communicate with the outside; the liquid reservoir is composed of a tubular body which is open at its lower end and is closed at its upper end; the liquid reservoir is joined to the outer tube such that communication is established between a lower end opening of the liquid reservoir and the opening of the outer tube of the double tube; and the lower end opening of the liquid reservoir serves as the refrigerant passage port.

9) An intermediate heat exchanger according to par. 1), wherein the liquid reservoir is composed of at least two constituent members which are detachably attached to each other; the double tube penetrates a selected one of the constituent members of the liquid reservoir, and the outer tube is fixed to the selected constituent member; and a plurality of refrigerant passage holes, which are through holes, are formed in a portion of the outer tube of the double tube located within the liquid reservoir so as to establish communication between the high-temperature-side refrigerant passage and the liquid reservoir.

10) An intermediate heat exchanger according to par. 9), wherein the refrigerant passage holes are formed in upper and lower parts of the portion of the outer tube located inside the liquid reservoir, the upper and lower parts being located on the upper and lower sides, respectively, of a center line of the portion located inside the liquid reservoir.

11) An intermediate heat exchanger according to par. 10), wherein the refrigerant passage holes formed in the portion of the outer tube located inside the liquid reservoir such that the refrigerant passage holes are formed at predetermined circumference intervals over the entire circumference of that portion and at predetermined intervals in a longitudinal direction of that portion.

12) An intermediate heat exchanger according to par. 9), wherein a desiccant container filled with desiccant is placed in the liquid reservoir.

13) An intermediate heat exchanger according to par. 9), wherein the double tube has a U-shaped portion which opens upward and which is composed of two opposed portions and a connection portion which connects lower end portions of the opposed portions together; at least a portion of the connection portion of the U-shaped portion is present within the liquid reservoir; and the refrigerant passage holes are formed in a portion of the outer tube which portion constitutes the connection portion of the double tube.

14) An intermediate heat exchanger according to par. 13), wherein the liquid reservoir is composed of a tubular body which is open at one end and is closed at the other end, and a cap which is removably attached to the open end of the tubular body so as to close the open end; and the connection portion of the U-shaped portion of the double tube penetrates the tubular body of the liquid reservoir.

15) An intermediate heat exchanger according to par. 13), wherein the liquid reservoir is composed of a tubular body which is open at one end and is closed at the other end, and a cap which is removably attached to the open end of the tubular body so as to close the open end; and the two opposed portions of the U-shaped portion of the double tube penetrates the cap of the liquid reservoir such that the connection portion is located in the liquid reservoir.

16) An intermediate heat exchanger according to par. 9), wherein the double tube has an L-shaped portion which is composed of a horizontal portion and a vertical portion extending from one end portion of the horizontal portion; the liquid reservoir is composed of a tubular body which is open at one end and is closed at the other end, and a cap which is removably attached to the open end of the tubular body so as to close the open end; the horizontal portion of the L-shaped portion of the double tube penetrates the tubular body of the liquid reservoir such that at least a portion of the horizontal portion is located within the liquid reservoir; and the refrigerant passage holes are formed in a portion of the outer tube which portion constitutes the horizontal portion of the double tube.

17) An intermediate heat exchanger according to par. 9), wherein the double tube and the circumference of the liquid reservoir are covered with a heat insulating material.

Effects of the Invention

According to the intermediate heat exchangers of pars. 1) to 17), the intermediate heat exchanger is composed of a double tube which includes an outer tube and an inner tube disposed inside the outer tube with a clearance formed therebetween, the clearance formed between the outer tube and the inner tube serving as a high-temperature-side refrigerant passage through which the refrigerant of high pressure flowing out of the condenser flows, and the interior of the inner tube serving as a low-temperature-side refrigerant passage through which the refrigerant of low pressure flowing out of the evaporator; and a liquid reservoir communicating with the high-temperature-side refrigerant passage of the double tube, the liquid reservoir storing the refrigerant of high pressure flowing out of the condenser in a stage before the pressure of the refrigerant is reduced by the pressure reducer, and separating liquid-phase refrigerant and gas-phase refrigerant from each other. The outer tube of the double tube has a refrigerant inlet and a refrigerant outlet which communicate with the high-temperature-side refrigerant passage. At an intermediate position between the refrigerant inlet and the refrigerant outlet, the refrigerant of high pressure enters the liquid reservoir from the high-temperature-side refrigerant passage of the double tube, and returns from the liquid reservoir to the high-temperature-side refrigerant passage. Thus, before the refrigerant having entered the high-temperature-side refrigerant passage of the double tube flows into the liquid reservoir, the refrigerant is cooled by the refrigerant flowing through the low-temperature-side refrigerant passage of the double tube. Accordingly, the refrigerant can be super-cooled in the double tube immediately before flowing into the liquid reservoir, and the liquid-phase refrigerant within the liquid reservoir can be stably maintained in a liquid phase without changing to gas-phase refrigerant. Thus, separation of liquid-phase refrigerant and gas-phase refrigerant can be performed efficiently within the liquid reservoir. As a result, the entirety of the effective core section of the condenser of an air conditioner including the intermediate heat exchanger can be used for condensation of refrigerant, whereby drop in the refrigerant condensation efficiency of the condenser can be prevented. In addition, since drop in the refrigerant condensation efficiency of the condenser can be prevented, the amount of refrigerant circulating through the air conditioner is not required to be reduced, whereby deterioration of cooling capacity can be prevented. Furthermore, since the refrigerant flowing through the high-temperature-side refrigerant passage and flowing into the liquid reservoir is super-cooled by the refrigerant flowing through the low-temperature-side refrigerant passage of the double tube, the super-cooling of refrigerant is not influenced by wind velocity and outside air temperature, whereby a stable degree of super cooling can be attained.

According to the intermediate heat exchangers of pars. 2) and 3), the length of the double tube can be increased in a region which becomes a dead space because of disposition of the liquid reservoir. Accordingly, the efficiency of heat exchange between the refrigerant of high pressure flowing through the high-temperature-side refrigerant passage and the refrigerant of low pressure flowing through the low-temperature-side refrigerant passage increases. In addition, since the connection portion of the U-shaped portion of the double tube and the horizontal portion of the L-shaped portion of the double tube are located on the lower side, the refrigerant can be caused to efficiently flow into the liquid reservoir, whereby the performance of separating liquid-phase refrigerant and gas-phase refrigerant is enhanced.

According to the intermediate heat exchanger of par. 9), the liquid reservoir is composed of at least two constituent members which are detachably attached to each other. Therefore, placement of a desiccant container and/or a filter into the liquid reservoir and removal thereof can be readily performed.

According to the intermediate heat exchangers of pars. 10) and 11), even in the case where a desiccant container filled with desiccant is placed in the liquid reservoir, it is possible to prevent the desiccant container from closing all the refrigerant passage holes. Accordingly, the flow of the refrigerant from the high-temperature-side refrigerant passage of the double tube into the liquid reservoir and the flow of the refrigerant from the liquid reservoir to the high-temperature-side refrigerant passage take place without any hindrance.

According to the intermediate heat exchangers of pars. 13) and 16), the length of the double tube can be increased in a region which becomes a dead space because of disposition of the liquid reservoir. Accordingly, the efficiency of heat exchange between the refrigerant of high pressure flowing through the high-temperature-side refrigerant passage and the refrigerant of low pressure flowing through the low-temperature-side refrigerant passage increases. In addition, since the connection portion of the U-shaped portion of the double tube and the horizontal portion of the L-shaped portion of the double tube are located on the lower side, the refrigerant can be caused to efficiently flow into the liquid reservoir, whereby the performance of separating liquid-phase refrigerant and gas-phase refrigerant is enhanced.

In the case where an air conditioner including the intermediate heat exchanger of par. 17) is used for a vehicle, the air conditioner is disposed in the engine compartment thereof. However, it is possible to prevent lowering of the effect of supper-cooling the refrigerant flowing through the high-temperature-side refrigerant passage of the double tube and re-evaporation of liquid-phase refrigerant within the liquid reservoir, which lowering and re-evaporation would otherwise occur due to heat within the engine compartment. Accordingly, deterioration of the performance of the air conditioner can be prevented or restrained.

If the effect of supper-cooling the refrigerant flowing through the high-temperature-side refrigerant passage of the double tube lowers and/or liquid-phase refrigerant within the liquid reservoir evaporates again, the range of the amount of refrigerant charged into the air conditioner in which the degree of supper cooling becomes constant becomes narrow, and the supper cooling characteristic for load variation and leakage of refrigerant may become instable. In order to solve such a problem, increasing the volume of the liquid reservoir is effective; however, in this case, a larger space is required.

Figure 1:
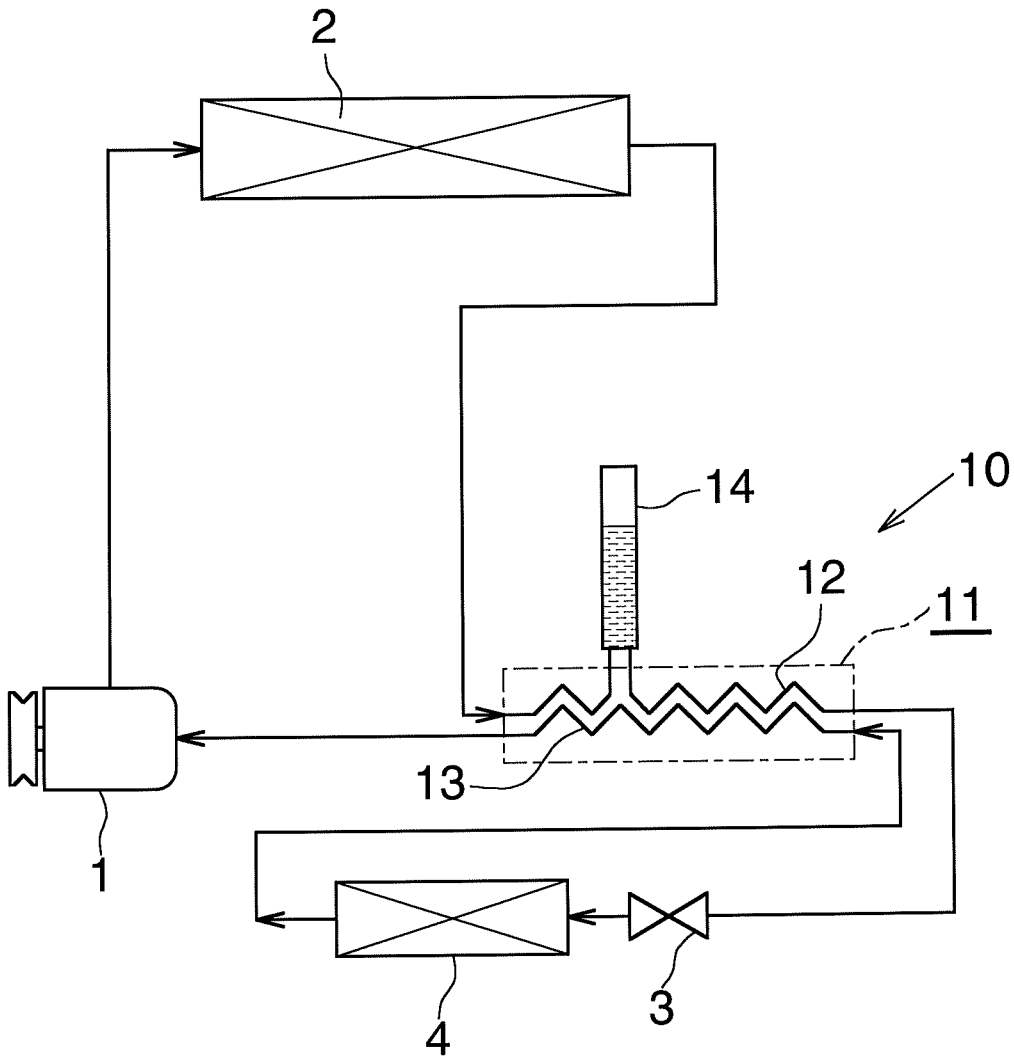
FIG. 1 Diagram showing the configuration of a vehicular air conditioner which uses an intermediate heat exchanger according to a first embodiment of the present invention.

DESCRIPTION OF REFERENCE NUMERALS (1): compressor
(2): condenser
(3): expansion valve (pressure reducer)
(4): evaporator
(10) (30) (40) (50) (60) (70): intermediate heat exchanger
(11) (31) (51) (61): double tube
(12): high-temperature-side refrigerant passage
(12A): refrigerant inlet side portion
(12B): refrigerant outlet side portion
(13): low-temperature-side refrigerant passage
(14) (32) (41) (71): liquid reservoir
(15) (33): outer tube
(15A): left constituting portion
(15B): right constituting portion
(16): inner tube
(17): refrigerant inlet
(18): refrigerant outlet
(19): refrigerant outflow port
(20): refrigerant inflow port
(21): tubular body
(22): refrigerant inflow port
(23): refrigerant outflow port
(24) (25): connection pipe
(35): opening
(36): tubular body
(37): refrigerant passage port
(42) (72): circular tubular body (constituent member)
(43) (73): cap (constituent member)
(44) (74): through hole
(45): desiccant container
(46): refrigerant passage hole
(47): heat insulating material
(52): U-shaped portion
(53): opposed portions
(54): connection portion
(62): L-shaped portion
(63): horizontal portion
(64): vertical portion

MODE FOR CARRYING OUT THE INVENTION

Embodiments of the present invention will now be described with reference to the drawings. In these embodiments, an intermediate heat exchanger of the present invention is used in a vehicular air conditioner mounted on a vehicle.

In the following description, the upper side, lower side, left-hand side, and right-hand side of FIGS. 2 to 4 will be referred to as "upper," "lower," "left," and "right," respectively.

Also, the term "aluminum" as used in the following description encompasses aluminum alloys in addition to pure aluminum.

First Embodiment

Figure 2:
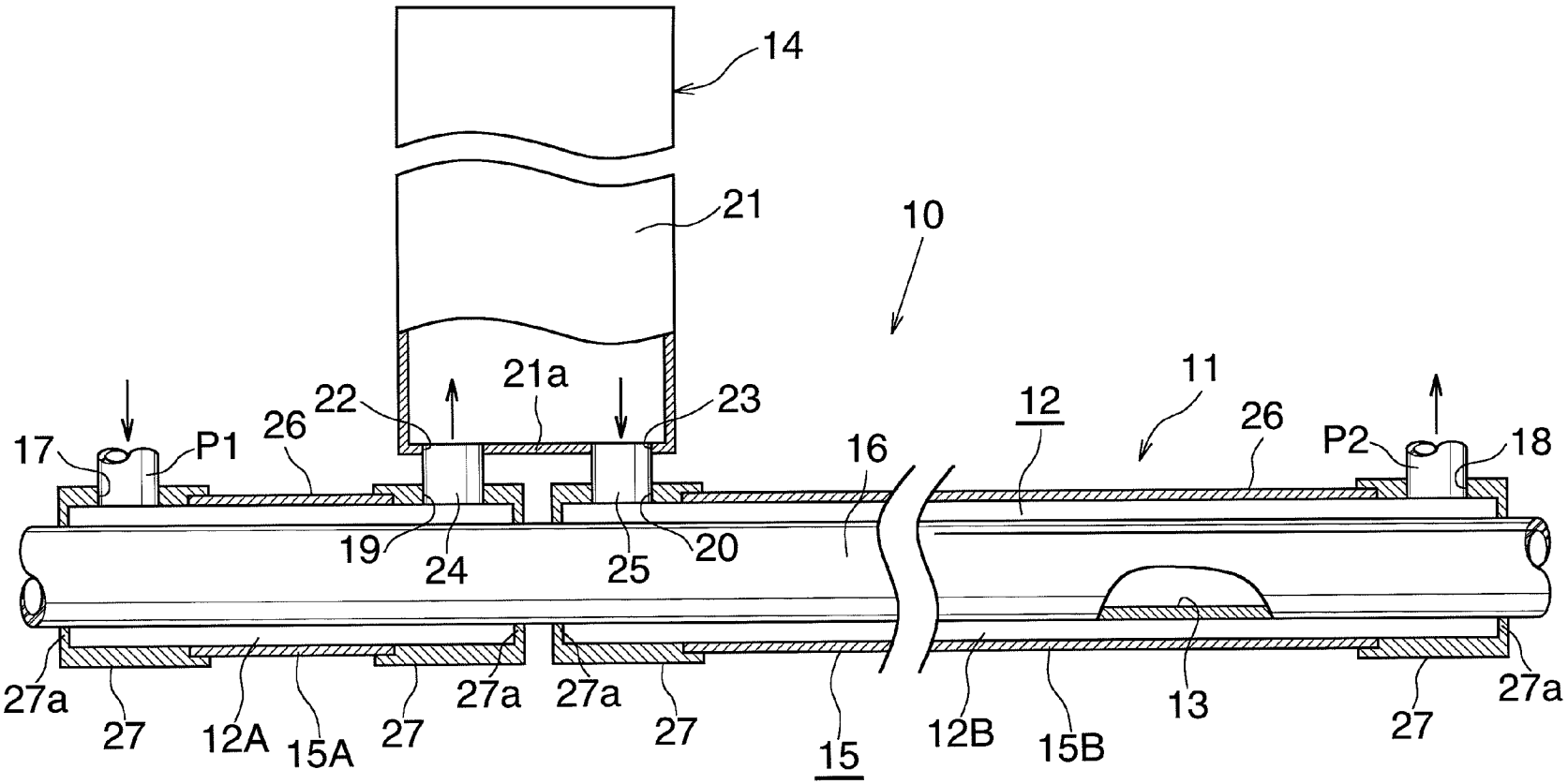
FIG. 2 Partially omitted vertical cross-sectional view showing the intermediate heat exchanger according to the first embodiment of the present invention.

FIGS. 1 and 2 show this embodiment.

FIG. 1 shows the configuration of a vehicular air conditioner which uses an intermediate heat exchanger of a first embodiment, and FIG. 2 shows the intermediate heat exchanger of the first embodiment.

The vehicular air conditioner shown in FIG. 1 includes an intermediate heat exchanger (10) composed of a double tube (11) and a liquid reservoir (14) formed of aluminum. The double tube (11) has a high-temperature-side refrigerant passage (12) through which refrigerant of high temperature and high pressure flowing out of a condenser (2) flows, and a low-temperature-side refrigerant passage (13) through which refrigerant of low temperature and low pressure flowing out of an evaporator (4) flows. The liquid reservoir (14) is fixed to the double tube (11) such that the liquid reservoir (14) communicates with the high-temperature-side refrigerant passage (12). The liquid reservoir (14) stores refrigerant of high pressure flowing out of the condenser (2) in a stage before the refrigerant is reduced in pressure by an expansion valve (3), and separates liquid-phase refrigerant and gas-phase refrigerant such that the liquid-phase refrigerant is stored in a lower portion of the liquid reservoir (14).

As shown in FIG. 2, the double tube (11) of the intermediate heat exchanger (10) includes an aluminum outer tube (15), and an aluminum inner tube (16) disposed inside the outer tube (15) with a clearance formed therebetween. The clearance between the outer tube (15) and the inner tube (16) serves as the high-temperature-side refrigerant passage (12), and the interior of the inner tube (16) serves as the low-temperature-side refrigerant passage (13). The outer tube (15) of the double tube (11) has a refrigerant inlet (17) communicating with one end portion (a left end portion, in the present embodiment) of the high-temperature-side refrigerant passage (12), and a refrigerant outlet (18) communicating with the other end portion (a right end portion, in the present embodiment) of the high-temperature-side refrigerant passage (12). A pipe (P1) extending from the condenser (2) is connected to the refrigerant inlet (17), and a pipe (P2) extending to the expansion valve (3) is connected to the refrigerant outlet (18). Notably, in FIG. 2, the refrigerant inlet (17) and the refrigerant outlet (18) face the same direction (in the present embodiment, upward); however, the refrigerant inlet (17) and the refrigerant outlet (18) may face different directions.

The outer tube (15) of the double tube (11) is composed of two tubular constituting portions (15A) (15B) formed of alumina and closed at opposite ends. The constituting portions (15A) (15B) are linearly arranged and spaced from each other in the left-right direction, whereby the high-temperature-side refrigerant passage (12) is divided into a refrigerant inlet side portion (12A) and a refrigerant outlet side portion (12B). The refrigerant inlet (17) is provided in a left end portion of the left constituting portion (15A) of the outer tube (15), and a refrigerant outflow port (19) from which refrigerant flows into the liquid reservoir (14) is provided in a right end portion of the left constituting portion (15A) of the outer tube (15). Similarly, the refrigerant outlet (18) is provided in a right end portion of the right constituting portion (15B) of the outer tube (15), and a refrigerant inflow port (20) to which refrigerant flows from the liquid reservoir (14) is provided in a left end portion of the right constituting portion (15B) of the outer tube (15). Notably, each of the left and right constituting portions (15A) (15B) of the outer tube (15) is composed of a tube (26) whose opposite ends are open, and two bottomed tubular closing members (27) each of which is open at one end and is closed at the other end. The open end portions of the two closing members (27) are joined to opposite ends of the tube (26) so as to close the opposite ends of the tube (26). The refrigerant inlet (17), the refrigerant outlet (18), the refrigerant outflow port (19), and the refrigerant inflow port (20) are formed in the corresponding closing members (27). The clearance between the left constituting portion (15A) of the outer tube (15) and the inner tube (16) serves as the refrigerant inlet side portion (12A) of the high-temperature-side refrigerant passage (12), and the clearance between the right constituting portion (15B) of the outer tube (15) and the inner tube (16) serves as the refrigerant outlet side portion (12B) of the high-temperature-side refrigerant passage (12).

Opposite ends of the inner tube (16) of the double tube (11) project outward from corresponding opposite ends of the outer tube (15). That is, the inner tube (16) extends through bottom walls (27*a*)*b* of the closing members (27) of the two constituting portions (15A) (15B) of the outer tube (15) such that a left end portion of the inner tube (16) projects leftward from a left end portion of the left constituting portion (15A) of the outer tube (15), and a right end portion of the inner tube (16) projects rightward from a right end portion of the right constituting portion (15B) of the outer tube (15). Although not shown in the drawings, a pipe extending from the evaporator (4) is connected to the right end of the inner tube (16), and a pipe extending to a compressor (1) is connected to the left end of the inner tube (16).

The liquid reservoir (14) is composed of a sealed tubular body (21) whose opposite ends are closed, and a refrigerant inflow port (22) and a refrigerant outflow port (23) are formed in a bottom wall (21*a*) of the tubular body (21). An aluminum connection pipe (24) connects together the refrigerant outflow port (19) of the left constituting portion (15A) of the outer tube (15) of the double tube (11) and the refrigerant inflow port (22) of the liquid reservoir (14). Another aluminum connection pipe (25) connects together the refrigerant inflow port (20) of the right constituting portion (15B) of the outer tube (15) of the double tube (11) and the refrigerant outflow port (23) of the liquid reservoir (14). That is, the connection pipe (24), which is joined at one end thereof to the outer tube (15) of the double tube (11) and is joined at the other end thereof to the liquid reservoir (14), establishes communication between the refrigerant inlet side portion (12A) of the high-temperature-side refrigerant passage (12) of the double tube (11) and the refrigerant inflow port (22) of the liquid reservoir (14). Similarly, the connection pipe (25), which is joined at one end thereof to the outer tube (15) of the double tube (11) and is joined at the other end thereof to the liquid reservoir (14), establishes communication between the refrigerant outlet side portion (12B) of the high-temperature-side refrigerant passage (12) of the double tube (11) and the refrigerant outflow port (23) of the liquid reservoir (14).

In the vehicular air conditioner shown in FIGS. 1 and 2, refrigerant of high temperature and high pressure in a gas/liquid mixed phase compressed by the compressor (1) is cooled in the condenser (2), and enters the refrigerant inlet side portion (12A) of the high-temperature-side refrigerant passage (12) via the refrigerant inlet (17) of the left constituting portion (15A) of the outer tube (15) of the double tube (11) of the intermediate heat exchanger (10). The refrigerant having entered the refrigerant inlet side portion (12A) of the high-temperature-side refrigerant passage (12) flows within the refrigerant inlet side portion (12A), and then enters the liquid reservoir (14) via the refrigerant outflow port (19), the connection pipe (24), and the refrigerant inflow port (22). In the liquid reservoir (14), the liquid phase and gas phase portions of the mixed phase refrigerant are separated from each other. The liquid-phase refrigerant flows out of the liquid reservoir (14) and enters the refrigerant outlet side portion (12B) of the high-temperature-side refrigerant passage (12) within the right constituting portion (15B) of the outer tube (15) of the double tube (11) via the refrigerant outflow port (23), the connection pipe (25), and the refrigerant inflow port (20). The refrigerant having entered the refrigerant outlet side portion (12B) of the high-temperature-side refrigerant passage (12) flows within the refrigerant outlet side portion (12B), flows out from the refrigerant outlet (18) of the right constituting portion (15B) of the outer tube (15), and is reduced in pressure by the expansion valve (3). The refrigerant of reduced pressure enters the evaporator (4), and cools air flowing through air-passage clearances while flowing through the evaporator (4), whereby the refrigerant becomes gas-phase refrigerant. The refrigerant of relatively low temperature having passed through the evaporator (4) passes through the low-temperature-side refrigerant passage (13) within the inner tube (16) of the double tube (11), and is fed to the compressor (1), where the refrigerant is compressed.

The refrigerant of high temperature and high pressure having fed from the condenser (2) and entered the refrigerant inlet side portion (12A) of the high-temperature-side refrigerant passage (12) of the double tube (11) in the intermediate heat exchanger (10) is cooled by the refrigerant of low temperature and low pressure flowing through the low-temperature-side refrigerant passage (13), while flowing through the refrigerant inlet side portion (12A). Therefore, during a period before the refrigerant of high temperature and high pressure flows into the liquid reservoir (14), the refrigerant of high temperature and high pressure is cooled by the refrigerant flowing through the low-temperature-side refrigerant passage (13) of the double tube (11). Accordingly, the refrigerant flowing into the liquid reservoir (14) is in a super-cooled state (see a state G of FIG. 10), whereby the liquid-phase refrigerant within the liquid reservoir (14) can be stably maintained in a liquid phase without changing to gas-phase refrigerant. Thus, separation of liquid-phase refrigerant and gas-phase refrigerant can be performed efficiently within the liquid reservoir (14). As a result, the entirety of the effective core section of the condenser (2) can be used for condensation of refrigerant, whereby drop in the refrigerant condensation efficiency of the condenser (2) can be prevented. In addition, since drop in the refrigerant condensation efficiency of the condenser (2) can be prevented, the amount of refrigerant circulating through the air conditioner is not required to be reduced, whereby deterioration of cooling capacity can be prevented. Furthermore, since the refrigerant flowing through the high-temperature-side refrigerant passage (12) and entering the liquid reservoir (14) is super-cooled by the refrigerant flowing through the low-temperature-side refrigerant passage (13) of the double tube (11) of the intermediate heat exchanger (10), the super-cooling of refrigerant is not influenced by wind velocity and outside air temperature, whereby a stable degree of super cooling can be attained.

Figure 9:
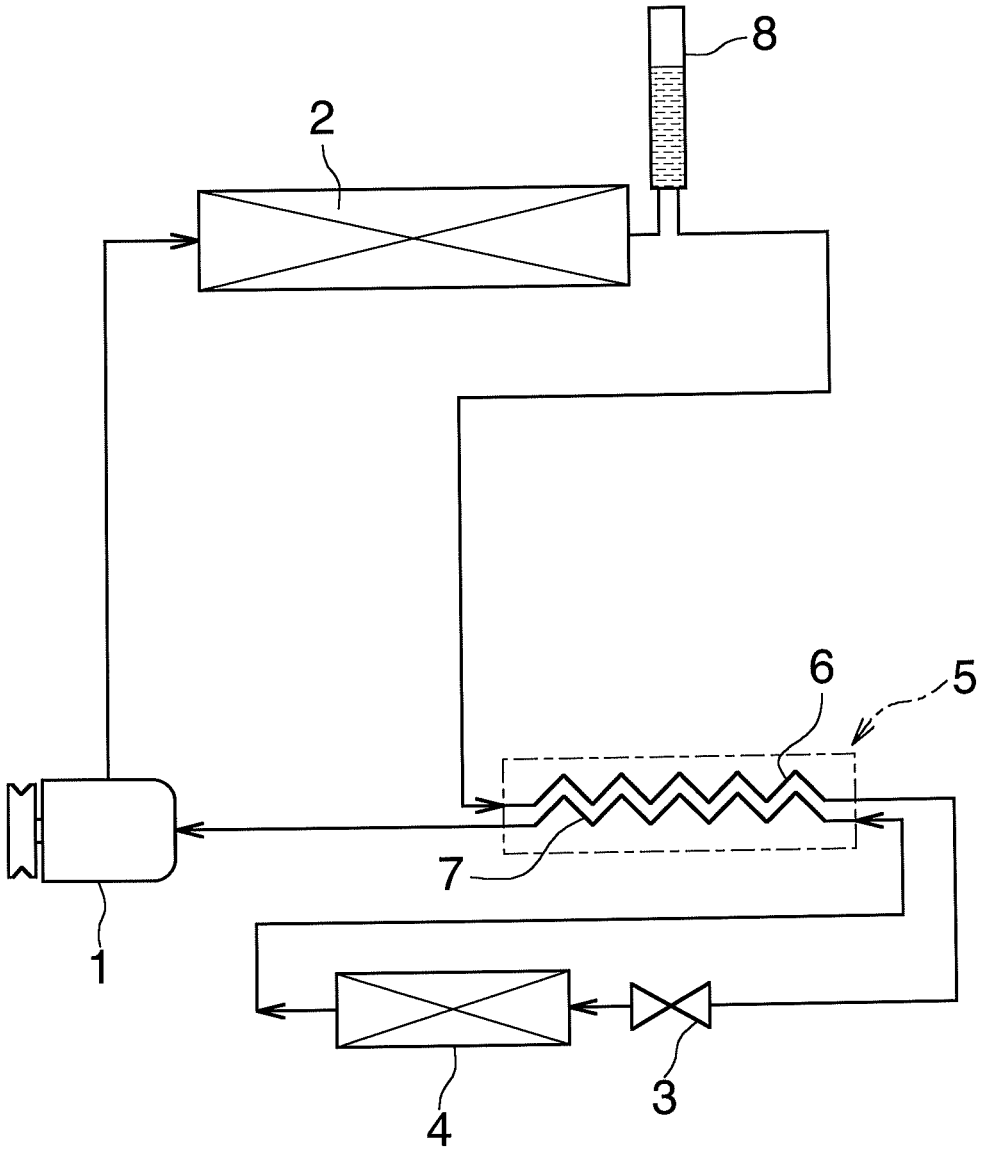
FIG. 9 Diagram showing the configuration of a conventional vehicular air conditioner.
Figure 10:
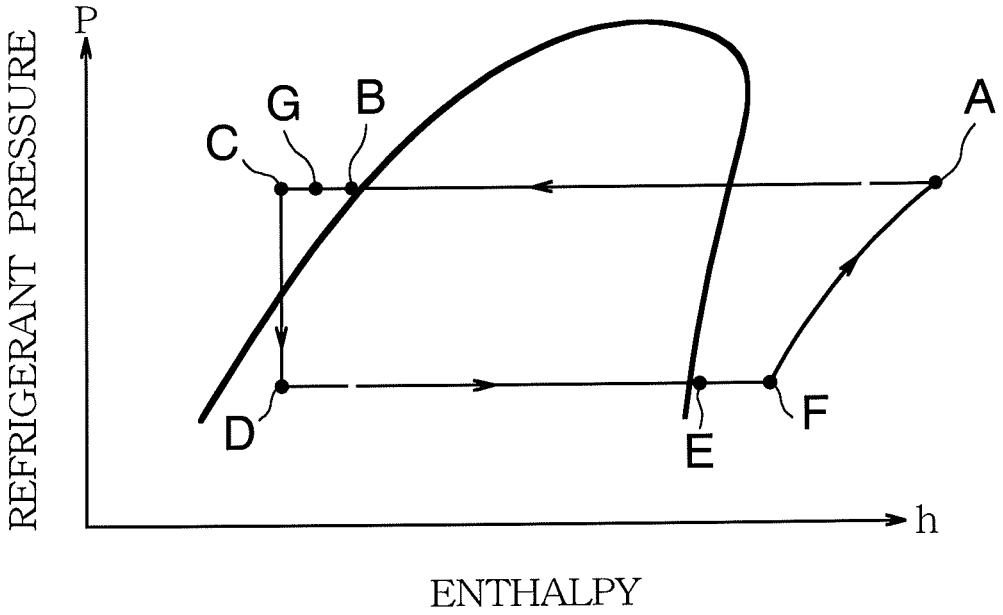
FIG. 10 Mollier diagram of the vehicular air conditioner.

Also, the refrigerant of high temperature and high pressure having flowed out of the liquid reservoir (14) and entered the refrigerant outlet side portion (12B) of the high-temperature-side refrigerant passage (12) of the double tube (11) is further cooled by the refrigerant of low temperature and low pressure flowing through the low-temperature-side refrigerant passage (13), while flowing through the refrigerant outlet side portion (12B), whereby the refrigerant of high temperature and high pressure is super-cooled to the state C of FIG. 10, as in the case of the conventional vehicular air conditioner shown in FIG. 9.

Second Embodiment

Figure 3:
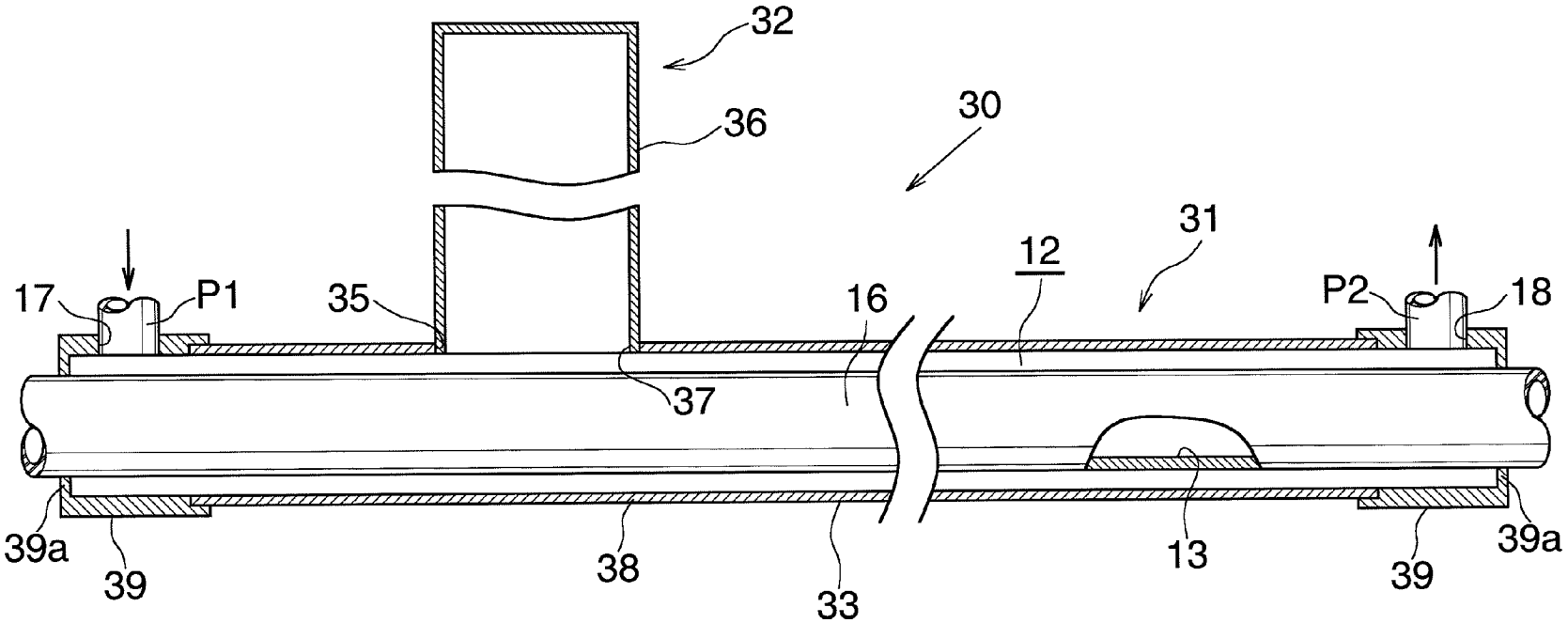
FIG. 3 Partially omitted vertical cross-sectional view showing an intermediate heat exchanger according to a second embodiment of the present invention.

FIG. 3 shows this embodiment.

As shown in FIG. 3, an intermediate heat exchanger (30) is composed of a double tube (31) having the high-temperature-side refrigerant passage (12) and the low-temperature-side refrigerant passage (13); and an aluminum liquid reservoir (32) fixed to the double tube (31) such that the liquid reservoir (32) communicates with the high-temperature-side refrigerant passage (12). The liquid reservoir (32) stores refrigerant of high pressure flowing out of the condenser (2) in a stage before the refrigerant is reduced in pressure by the expansion valve (3), separates liquid-phase refrigerant and gas-phase refrigerant from each other, and stores the liquid-phase refrigerant in a lower portion of the liquid reservoir (32).

The double tube (31) of the intermediate heat exchanger (30) includes an aluminum outer tube (33), and the aluminum inner tube (16) disposed inside the outer tube (33) with a clearance formed therebetween. The clearance between the outer tube (33) and the inner tube (16) serves as the high-temperature-side refrigerant passage (12), and the interior of the inner tube (34) serves as the low-temperature-side refrigerant passage (13). The outer tube (33) of the double tube (31) has the refrigerant inlet (17) communicating with one end portion (a left end portion, in the present embodiment) of the high-temperature-side refrigerant passage (12), and the refrigerant outlet (18) communicating with the other end portion (a right end portion, in the present embodiment) of the high-temperature-side refrigerant passage (12). Furthermore, an opening (35) is formed in an upper portion of the wall of the outer tube (33) for enabling the high-temperature-side refrigerant passage (12) to communicate with the outside. Notably, the outer tube (33) of the double tube (31) is composed of a single tube (38) whose opposite ends are open, and two bottomed tubular closing members (39) each of which is open at one end and is closed at the other end. The open end portions of the two closing members (39) are joined to opposite ends of the tube (38) so as to close the opposite ends of the tube (38). The refrigerant inlet (17) and the refrigerant outlet (18) are formed in the corresponding closing members (39).

Opposite ends of the inner tube (16) of the double tube (31) project outward from corresponding opposite ends of the outer tube (33), and the inner tube (16) extends through bottom walls (39*a*) of the closing members (39) of the outer tube (33).

The liquid reservoir (32) is composed of a sealed tubular body (36) whose lower end is open and whose upper end is closed. A lower end portion of the tubular body (36) of the liquid reservoir (32) is joined to the outer tube (33) such that a lower end opening of the tubular body (36) communicates with the opening (35) of the outer tube (33) of the double tube (31). The lower end opening of the tubular body (36) of the liquid reservoir (32) serves as a refrigerant passage port (37) which is located below the interface between liquid-phase refrigerant and gas-phase refrigerant separated within the liquid reservoir (32). Thus, communication is established between the high-temperature-side refrigerant passage (12) of the double tube (31) and the refrigerant passage port (37) of the liquid reservoir (32).

Operation of a vehicular air conditioner which uses the intermediate heat exchanger (30) of the second embodiment is substantially the same as that of the vehicular air conditioner shown in FIG. 1.

The refrigerant of high temperature and high pressure having fed from the condenser (2) and entered the high-temperature-side refrigerant passage (12) of the double tube (31) via the refrigerant inlet (17) is cooled to a super-cooled state by the refrigerant of low temperature and low pressure flowing through the low-temperature-side refrigerant passage (13), while flowing through the high-temperature-side refrigerant passage (12). The super-cooled refrigerant enters the liquid reservoir (32) via the opening (35) of the outer tube (33) and the refrigerant passage port (37) of the liquid reservoir (32), in which liquid-phase refrigerant and gas-phase refrigerant are separated from each other. The liquid-phase refrigerant within the liquid reservoir (32) returns to the high-temperature-side refrigerant passage (12) of the double tube (31) via the refrigerant passage port (37) of the liquid reservoir (32) and the opening (35) of the outer tube (33), and is fed to the expansion valve (3) from the refrigerant outlet (18).

Since the refrigerant flowing into the liquid reservoir (32) is in a super-cooled state (see the state G of FIG. 10), the liquid-phase refrigerant within the liquid reservoir (32) can be stably maintained in a liquid phase without changing to gas-phase refrigerant. Thus, separation of liquid-phase refrigerant and gas-phase refrigerant can be performed efficiently within the liquid reservoir (32). As a result, the entirety of the effective core section of the condenser (2) can be used for condensation of refrigerant, whereby drop in the refrigerant condensation efficiency of the condenser (2) can be prevented. In addition, since drop in the refrigerant condensation efficiency of the condenser (2) can be prevented, the amount of refrigerant circulating through the air conditioner is not required to be reduced, whereby deterioration of cooling capacity can be prevented. Furthermore, since the refrigerant flowing through the high-temperature-side refrigerant passage (12) and entering the liquid reservoir (32) is super-cooled by the refrigerant flowing through the low-temperature-side refrigerant passage (13) of the double tube (31), the super-cooling of refrigerant is not influenced by wind velocity and outside air temperature, whereby a stable degree of super cooling can be attained.

Also, the refrigerant of high temperature and high pressure having flowed out of the liquid reservoir (32) and entered the high-temperature-side refrigerant passage (12) of the double tube (31) is further cooled by the refrigerant of low temperature and low pressure flowing through the low-temperature-side refrigerant passage (13), before flowing out from the refrigerant outlet (18), whereby the refrigerant of high temperature and high pressure is super-cooled to the state C of FIG. 10, as in the case of the conventional vehicular air conditioner shown in FIG. 9.

Although not shown in the drawings, desiccant for removing moisture from refrigerant or a filter for removing foreign substances from refrigerant may be disposed in the liquid reservoirs (14) (32) of the intermediate heat exchangers (10) (30) of the first and second embodiments.

Third Embodiment

Figure 4:
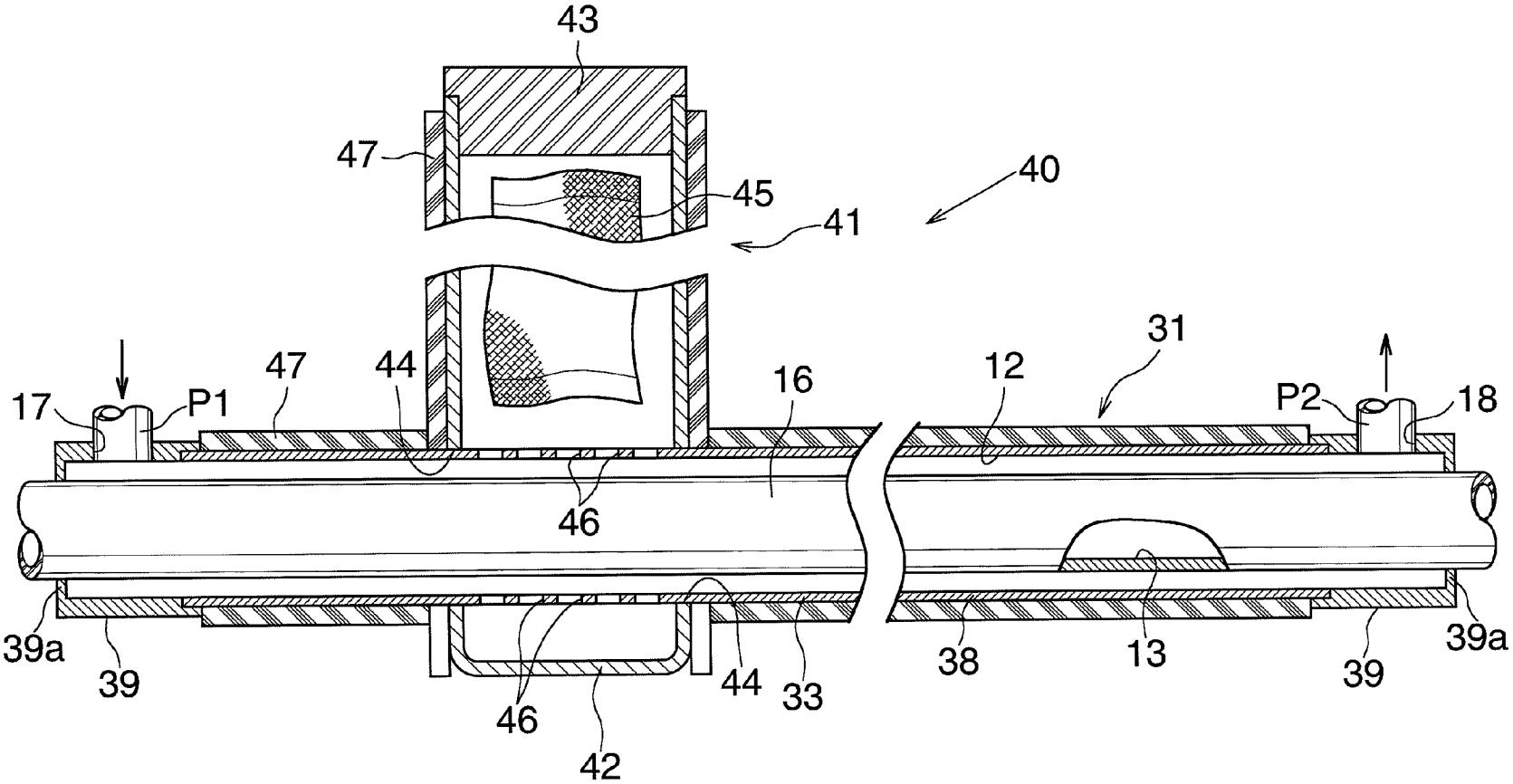
FIG. 4 Partially omitted vertical cross-sectional view showing an intermediate heat exchanger according to a third embodiment of the present invention.
Figure 5:
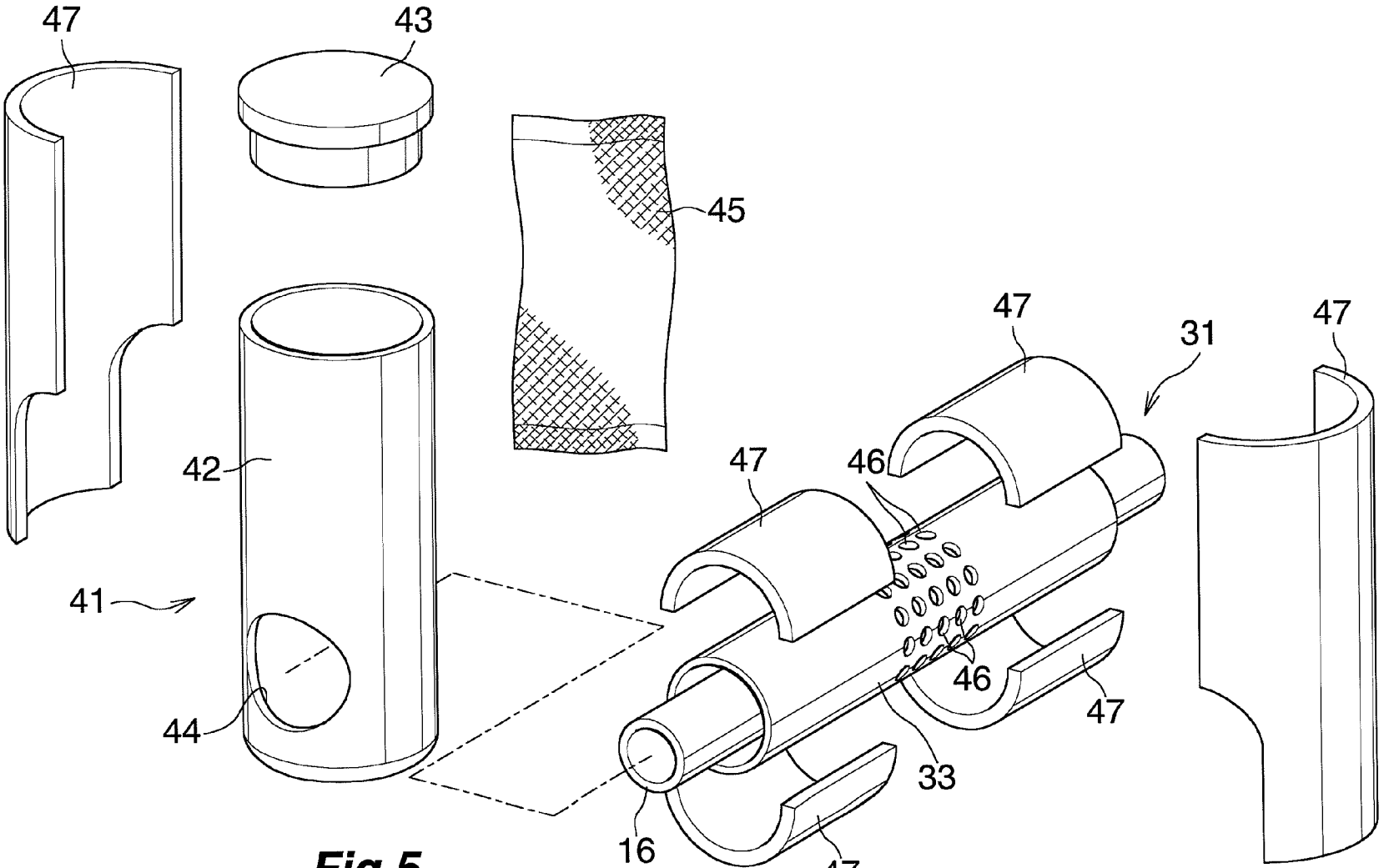
FIG. 5 Exploded perspective view showing a portion of the intermediate heat exchanger of FIG. 4.

FIGS. 4 and 5 show this embodiment.

In an intermediate heat exchanger (40) shown in FIGS. 4 and 5, a liquid reservoir (41) fixed to the double tube (31) such that the liquid reservoir (41) communicates with the high-temperature-side refrigerant passage (12) is composed of a circular tubular body (42) whose upper end is open and whose lower end is closed; and a cap (43) which is removably attached to the upper end of the circular tubular body (42) so as to close the upper end opening of the circular tubular body (42). The circular tubular body (42) has two through holes (44) formed in its circumferential wall to be located above the bottom wall thereof and on a single diametrical line. The double tube (31) is passed through these through holes (44), and the outer tube (33) is joined to the circular tubular body (42). Thus, the double tube (31) penetrates the circular tubular body (42) of the liquid reservoir (41). A bag-shaped desiccant container (45) filled with desiccant is placed in the liquid reservoir (42) at a position above the double tube (31). Notably, a filter may be placed in the liquid reservoir (41).

A plurality of refrigerant passage holes (through holes) (46) are formed in a portion of the outer tube (33) of the double tube (31) located within the liquid reservoir (41) so as to establish communication between the high-temperature-side refrigerant passage (12) and the liquid reservoir (41). The refrigerant passage holes (46) are formed in the outer tube (31) at predetermined circumferential intervals over the enter circumference and at predetermined intervals in the longitudinal direction thereof such that the refrigerant passage holes (46) are present on the upper and lower parts of the portion located within the liquid reservoir (41), the upper and lower parts being located on the upper and lower sides, respectively, of the center line of the outer tube (31).

Portions of the outer tube (33) of the double tube (31) located outside the liquid reservoir (41) and the circumference of the circumferential wall of the circular tubular body (42) of the liquid reservoir (41) is covered with a heat insulating material (47). Notably, the lower surface of the bottom wall of the circular tubular body (42) of the liquid reservoir (41) and the upper surface of the cap (43) may be covered with the heat insulating material (47).

Operation of a vehicular air conditioner which uses the intermediate heat exchanger (40) of the third embodiment is the same as that of the vehicular air conditioner which uses the intermediate heat exchanger (30) of the second embodiment.

Fourth Embodiment

Figure 6:
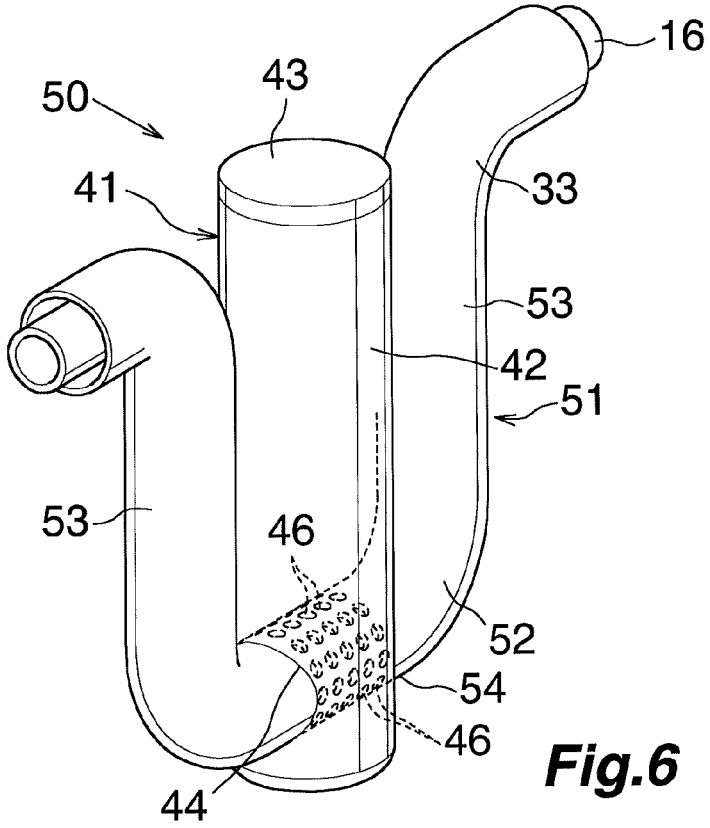
FIG. 6 Perspective view showing a portion of an intermediate heat exchanger according to a fourth embodiment of the present invention.

FIG. 6 shows this embodiment.

A double tube (51) of an intermediate heat exchanger (50) shown in FIG. 6, which includes the outer tube (33) and the inner tube (16), has a U-shaped portion (52) which is open upward and which is composed of a pair of opposed portions (53) and a connection portion (54) which connects lower end portions of the opposed portions (53) together. A portion (with respect to the longitudinal direction) of the connection portion (54) of the U-shaped portion (52) of the double tube (51) is passed through the two through holes (44) formed in the circumferential wall of the circular tubular body (42) of the liquid reservoir (41), and the outer tube (33) is joined to the circular tubular body (42), whereby the connection portion (54) of the U-shaped portion (52) penetrates the circular tubular body (42).

Fifth Embodiment

Figure 7:
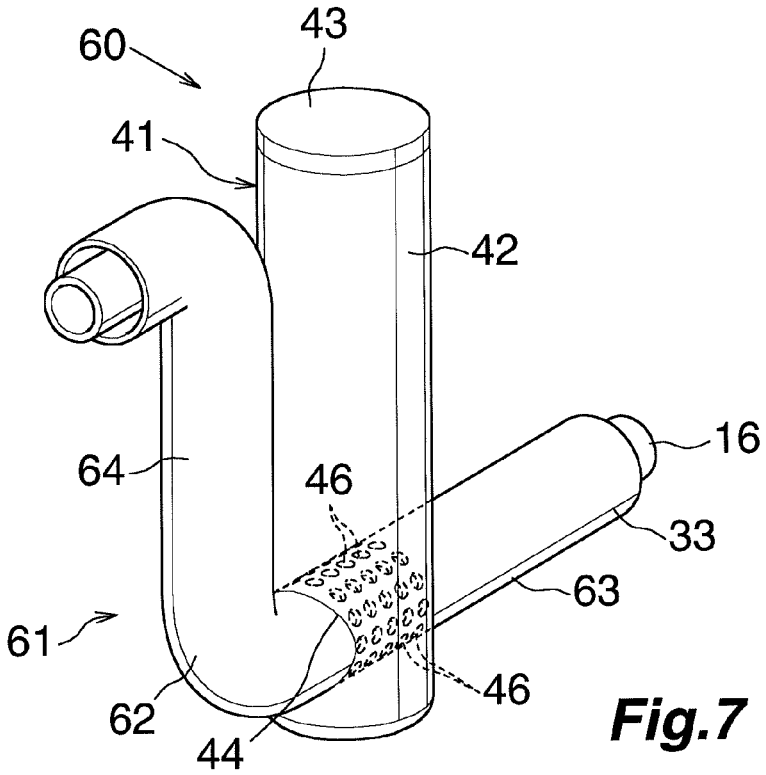
FIG. 7 Perspective view showing a portion of an intermediate heat exchanger according to a fifth embodiment of the present invention.

FIG. 7 shows this embodiment.

A double tube (61) of an intermediate heat exchanger (60) shown in FIG. 7, which includes the outer tube (33) and the inner tube (16), has an L-shaped portion (62) composed of a horizontal portion (63) and a vertical portion (64) extending from one end of the horizontal portion (63). A portion (with respect to the longitudinal direction) of the horizontal portion (63) of the L-shaped portion (62) is passed through the two through holes (44) formed in the circumferential wall of the circular tubular body (42) of the liquid reservoir (41), and the outer tube (33) is joined to the circular tubular body (42), whereby the horizontal portion (63) of the L-shaped portion (62) penetrates the circular tubular body (42).

Sixth Embodiment

Figure 8:
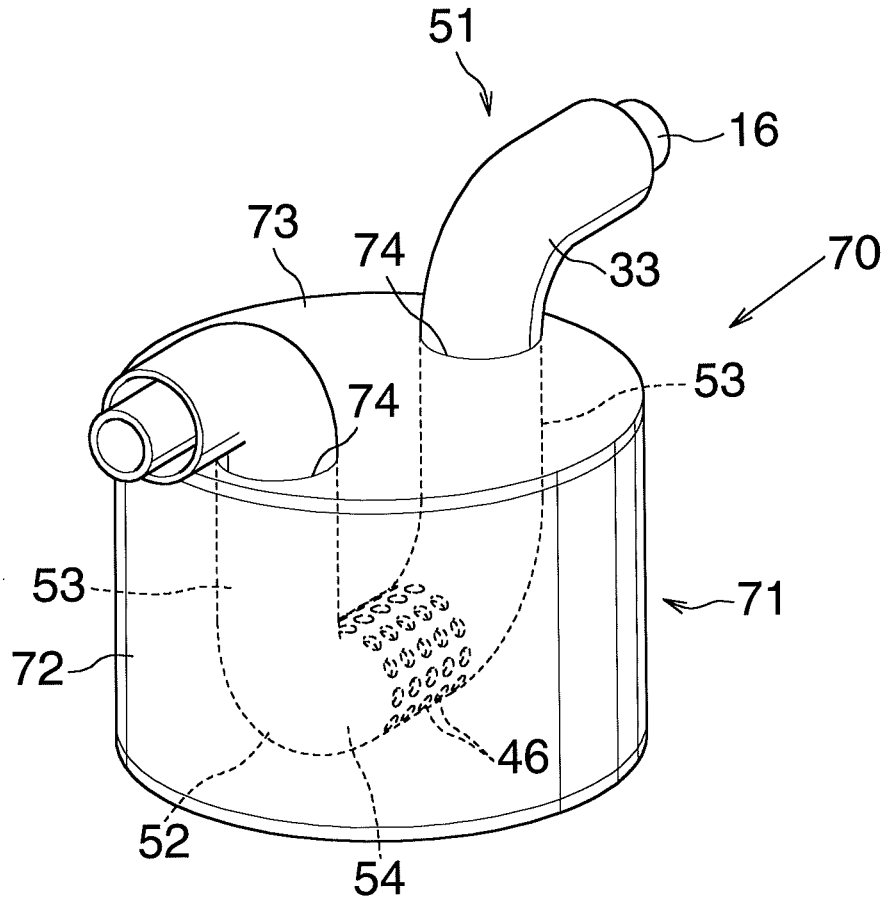
FIG. 8 Perspective view showing a portion of an intermediate heat exchanger according to a sixth embodiment of the present invention.

FIG. 8 shows this embodiment.

A liquid reservoir (71) of an intermediate heat exchanger (70) shown in FIG. 6 is composed of a circular tubular body (72) which is open at the upper end and closed at the lower end thereof and which is larger in diameter than the circular tubular body (42) shown in FIGS. 4 and 5; and a cap (73) which is removably attached to the upper end of the circular tubular body (72) so as to close the upper end opening of the circular tubular body (72). Two through holes (74) are formed in the cap (73). The opposed portions (53) of the U-shaped portion (52) of the double tube (51) are passed through the two through holes (74) formed in the cap (73) of the liquid reservoir (71), and the outer tube (33) is joined to the cap (73). Thus, the opposed portions (53) of the U-shaped portion (52) penetrates the cap (73) such that the connection portion (54) is located in the liquid reservoir (71).

Notably, although not shown in the drawings, preferably, the intermediate heat exchangers (50) (60) (70) of the fourth through sixth embodiments are configured such that the circumference of portions of the outer tube (33) of the double tube (51) (61) located outside the liquid reservoir (41) (71), the circumference of the circumferential wall of the circular tubular body (42) (72) of the liquid reservoir (41) (71), the lower surface of the bottom wall of the circular tubular body (42) (72), and the upper surface of the cap (43) (73) are covered with a heat insulating material. Furthermore, a desiccant container filled with desiccant for removing moisture from refrigerant or a filter for removing foreign substances from refrigerant may be disposed in the liquid reservoirs (41) (71) of the intermediate heat exchangers (50) (60) (70) of the fourth through sixth embodiments.

In the intermediate heat exchangers (40) (50) (60) (70) of the above-described third through sixth embodiments, the liquid reservoir (41) (71) is composed of two constituent members. However, the structure of the liquid reservoir (41) (71) is not limited thereto, and the liquid reservoir (41) (71) may be composed of three or more constituent members.

INDUSTRIAL APPLICABILITY

The intermediate heat exchanger of the present invention is suitably used for air conditioners mounted on vehicles.

The invention claimed is:

1. An intermediate heat exchanger used in an air conditioner including a compressor, a condenser for cooling refrigerant compressed by the compressor, a pressure reducer for reducing pressure of the refrigerant cooled by the condenser, and an evaporator for evaporating the refrigerant of reduced pressure, the intermediate heat exchanger exchanging heat between refrigerant of high pressure flowing out of the condenser and refrigerant of low pressure flowing out of the evaporator, wherein the intermediate heat exchanger is composed of a double tube which includes an outer tube and an inner tube disposed inside the outer tube with a clearance formed therebetween, the clearance formed between the outer tube and the inner tube serving as a high-temperature-side refrigerant passage through which the refrigerant of high pressure flowing out of the condenser flows, and the interior of the inner tube serving as a low-temperature-side refrigerant passage through which the refrigerant of low pressure flowing out of the evaporator flows; and a liquid reservoir communicating with the high-temperature-side refrigerant passage of the double tube, the liquid reservoir storing the refrigerant of high pressure, flowing out of the condenser, in a stage before the pressure of the refrigerant is reduced by the pressure reducer, and separating liquid-phase refrigerant and gas-phase refrigerant from each other; and the outer tube of the double tube has a refrigerant inlet and a refrigerant outlet which communicate with the high-temperature-side refrigerant passage, wherein, at an intermediate position between the refrigerant inlet and the refrigerant outlet, the refrigerant of high pressure enters the liquid reservoir from the high-temperature-side refrigerant passage of the double tube, and returns from the liquid reservoir to the high-temperature-side refrigerant passage.

2. An intermediate heat exchanger according to claim 1, wherein the double tube has a U-shaped portion which opens upward and which is composed of two opposed portions and a connection portion which connects lower end portions of the opposed portions together, wherein, at the connection portion of the U-shaped portion, the refrigerant flows from the high-temperature-side refrigerant passage of the double tube into the liquid reservoir, and returns from the liquid reservoir to the high-temperature-side refrigerant passage.

3. An intermediate heat exchanger according to claim 1, wherein the double tube has an L-shaped portion which is composed of a horizontal portion and a vertical portion extending from one end portion of the horizontal portion, wherein, at the horizontal portion of the L-shaped portion, the refrigerant flows from the high-temperature-side refrigerant passage of the double tube into the liquid reservoir, and returns from the liquid reservoir to the high-temperature-side refrigerant passage.

4. An intermediate heat exchanger according to claim 1, wherein the high-temperature-side refrigerant passage of the double tube is divided into a refrigerant inlet side portion and a refrigerant outlet side portion; the liquid reservoir has a refrigerant inflow port and a refrigerant outflow port; and communication is established between the refrigerant inlet side portion of the high-temperature-side refrigerant passage of the double tube and the refrigerant inflow port of the liquid reservoir, and communication is established between the refrigerant outlet side portion of the high-temperature-side refrigerant passage of the double tube and the refrigerant outflow port of the liquid reservoir.

5. An intermediate heat exchanger according to claim 4, wherein a connection pipe which is joined at one end thereof to the outer tube of the double tube and is joined at the other end thereof to the liquid reservoir establishes communication between the refrigerant inlet side portion of the high-temperature-side refrigerant passage of the double tube and the refrigerant inflow port of the liquid reservoir, and another connection pipe which is joined at one end thereof to the outer tube of the double tube and is joined at the other end thereof to the liquid reservoir establishes communication between the refrigerant outlet side portion of the high-temperature-side refrigerant passage of the double tube and the refrigerant outflow port of the liquid reservoir.

6. An intermediate heat exchanger according to claim 4, wherein the outer tube of the double tube is composed of two tubular constituting portions; and the refrigerant inlet side portion of the high-temperature-side refrigerant passage is provided in one tubular constituting portion, and the refrigerant outlet side portion of the high-temperature-side refrigerant passage is provided in the other tubular constituting portion.

7. An intermediate heat exchanger according to claim 1, wherein the liquid reservoir has a refrigerant passage port located below an interface between liquid-phase refrigerant and gas-phase refrigerant within the liquid reservoir, and communication is established between the high-temperature-side refrigerant passage of the double tube and the refrigerant passage port of the liquid reservoir.

8. An intermediate heat exchanger according to claim 7, wherein an opening is formed in the outer tube of the double tube for enabling the high-temperature-side refrigerant passage to communicate with the outside; the liquid reservoir is composed of a tubular body which is open at its lower end and is closed at its upper end; the liquid reservoir is joined to the outer tube such that communication is established between a lower end opening of the liquid reservoir and the opening of the outer tube of the double tube; and the lower end opening of the liquid reservoir serves as the refrigerant passage port.

9. An intermediate heat exchanger according to claim 1, wherein the liquid reservoir is composed of at least two constituent members which are detachably attached to each other; the double tube penetrates a selected one of the constituent members of the liquid reservoir, and the outer tube is fixed to the selected constituent member; and a plurality of refrigerant passage holes, which are through holes, are formed in a portion of the outer tube of the double tube located within the liquid reservoir so as to establish communication between the high-temperature-side refrigerant passage and the liquid reservoir.

10. An intermediate heat exchanger according to claim 9, wherein the refrigerant passage holes are formed in upper and lower parts of the portion of the outer tube located inside the liquid reservoir, the upper and lower parts being located on the upper and lower sides, respectively, of a center line of the portion located inside the liquid reservoir.

11. An intermediate heat exchanger according to claim 10, wherein the refrigerant passage holes formed in the portion of the outer tube located inside the liquid reservoir such that the refrigerant passage holes are formed at predetermined circumference intervals over the entire circumference of that portion and at predetermined intervals in a longitudinal direction of that portion.

12. An intermediate heat exchanger according to claim 9, wherein a desiccant container filled with desiccant is placed in the liquid reservoir.

13. An intermediate heat exchanger according to claim 9, wherein the double tube has a U-shaped portion which opens upward and which is composed of two opposed portions and a connection portion which connects lower end portions of the opposed portions together; at least a portion of the connection portion of the U-shaped portion is present within the liquid reservoir; and the refrigerant passage holes are formed in a portion of the outer tube which portion constitutes the connection portion of the double tube.

14. An intermediate heat exchanger according to claim 13, wherein the liquid reservoir is composed of a tubular body which is open at one end and is closed at the other end, and a cap which is removably attached to the open end of the tubular body so as to close the open end; and the connection portion of the U-shaped portion of the double tube penetrates the tubular body of the liquid reservoir.

15. An intermediate heat exchanger according to claim 13, wherein the liquid reservoir is composed of a tubular body which is open at one end and is closed at the other end, and a cap which is removably attached to the open end of the tubular body so as to close the open end; and the two opposed portions of the U-shaped portion of the double tube penetrates the cap of the liquid reservoir such that the connection portion is located in the liquid reservoir.

16. An intermediate heat exchanger according to claim 9, wherein the double tube has an L-shaped portion which is composed of a horizontal portion and a vertical portion extending from one end portion of the horizontal portion; the liquid reservoir is composed of a tubular body which is open at one end and is closed at the other end, and a cap which is removably attached to the open end of the tubular body so as to close the open end; the horizontal portion of the L-shaped portion of the double tube penetrates the tubular body of the liquid reservoir such that at least a portion of the horizontal portion is located within the liquid reservoir; and the refrigerant passage holes are formed in a portion of the outer tube which portion constitutes the horizontal portion of the double tube.

17. An intermediate heat exchanger according to claim 9, wherein the double tube and the circumference of the liquid reservoir are covered with a heat insulating material.

* * * * *